US008292131B2

(12) United States Patent
Pruvot

(10) Patent No.: US 8,292,131 B2
(45) Date of Patent: Oct. 23, 2012

(54) FLUID DISPENSER PUMP

(75) Inventor: Samuel Pruvot, Saint Etienne du Vauvray (FR)

(73) Assignee: Aptar France SAS, Le Neubourg (FR)

( * ) Notice: Subject to any disclaimer, the term of this patent is extended or adjusted under 35 U.S.C. 154(b) by 1111 days.

(21) Appl. No.: 12/089,807

(22) PCT Filed: Oct. 17, 2006

(86) PCT No.: PCT/FR2006/051037

§ 371 (c)(1),
(2), (4) Date: Aug. 8, 2008

(87) PCT Pub. No.: WO2007/045791

PCT Pub. Date: Apr. 26, 2007

(65) Prior Publication Data

US 2009/0140010 A1 Jun. 4, 2009

(30) Foreign Application Priority Data

Oct. 17, 2005 (FR) ..... 05 53139

(51) Int. Cl.
*B65D 88/54* (2006.01)

(52) U.S. Cl. ..... 222/321.6; 222/340; 222/378; 239/333

(58) Field of Classification Search ..... 222/318–321.9, 222/340–341, 372–385; 239/333
See application file for complete search history.

(56) References Cited

U.S. PATENT DOCUMENTS

| | | | | |
|---|---|---|---|---|
| 3,388,839 | A | 6/1968 | Frydenberg | |
| 5,692,649 | A * | 12/1997 | Schwab | 222/321.3 |
| 5,947,340 | A * | 9/1999 | Arnold et al. | 222/321.9 |
| 7,147,135 | B2 * | 12/2006 | Le Maner | 222/321.9 |
| 7,780,042 | B2 * | 8/2010 | Pruvot | 222/321.7 |
| 7,798,375 | B2 * | 9/2010 | Le Maner | 222/321.7 |
| 7,870,978 | B2 * | 1/2011 | Pardonge et al. | 222/321.7 |
| 7,882,988 | B2 * | 2/2011 | Nicolle et al. | 222/321.9 |
| 2007/0131799 | A1 | 6/2007 | Le Maner et al. | |

FOREIGN PATENT DOCUMENTS

| | | | |
|---|---|---|---|
| EP | 0 251 863 | A1 | 1/1988 |
| FR | 2 862 009 | A1 | 5/2005 |
| WO | WO 2005044465 | A2 * | 5/2005 |

* cited by examiner

*Primary Examiner* — Kevin P Shaver
*Assistant Examiner* — Andrew P Bainbridge
(74) *Attorney, Agent, or Firm* — Sughrue Mion, PLLC

(57) ABSTRACT

A fluid dispenser pump has a fluid reservoir, and a pump that has a pump chamber with a piston that moves within the pump chamber to pump fluids out a dispensing orifice. The pump has a priming air channel that fluidly connects the reservoir to the pump chamber and is separate from the fluid channel that connects the reservoir to the pump chamber. With non-sterile fluids, such as medicine, the air channel cannot displace the air to the exterior of the dispenser, but must displace it to the reservoir where it assists in priming the fluid channel.

17 Claims, 3 Drawing Sheets

FLUID DISPENSER PUMP

CROSS REFERENCE TO RELATED APPLICATIONS

This application is a National Stage of International Application No. PCT/FR2006/051037 filed on Oct. 17, 2006, claiming priority based on French Patent Application No. 0553139, filed Oct. 17, 2005, the contents of all of which are incorporated herein by reference in their entirety.

The present invention relates to a fluid dispenser pump and to a fluid dispenser device including such a pump.

Fluid dispenser pumps are well known in the prior art, in particular for dispensing fluids in the fields of cosmetics, perfumery, or pharmacy. They generally comprise a piston that slides in a pump body, more particularly in a pump chamber provided in the pump body, the piston being adapted to dispense a dose of fluid each time the pump is actuated. The pump chamber generally includes an inlet valve member making it possible to define the magnitude of the fluid dose that is expelled on each actuation. In addition, in particular with pharmaceutical fluids, some pumps sometimes incorporate closure members at the dispenser orifice, so as to avoid any contamination of the fluid between two actuations.

A problem that exists with that type of pump relates to priming. Before the pump is actuated for the first time, the pump chamber is full of air, and it is therefore necessary to expel all of that air so as to enable said pump chamber to be filled with fluid, and so as to make it possible to measure out a dose that is accurate and reproducible each time the pump is actuated. Priming is made all the more complicated since the pump or the dispenser device includes a closure member. It is difficult to expel the air that is contained in the pump chamber out of said pump chamber, in particular because of the presence of said closure member. In that type of device, and, in particular, in devices known as "Preservative Free Systems" (PFS), i.e. devices including no preservatives so as to avoid contamination of the fluid, the presence of the closure member at the dispenser orifice prevents priming air from being expelled from the pump chamber through the dispenser orifice. The priming air must thus be expelled towards the inside of the reservoir, and, in a conventional pump, this is achieved using the dip tube, having the main function of delivering fluid from the reservoir to the pump chamber.

Particularly with fluids that are relatively viscous, such priming is complicated, or even impossible, in particular when the priming needs to take place by returning the priming air into the reservoir via the dip tube.

An object of the present invention is to provide a fluid dispenser pump that does not have the above-mentioned drawbacks.

More particularly, an object of the present invention is to provide a fluid dispenser pump that makes it possible to achieve safe and reliable priming in a manner that is simple and inexpensive, even for viscous fluids.

Another object of the present invention is to provide a fluid dispenser pump that guarantees an atomized spray each time the pump is actuated, regardless of the force that the user exerts on said pump while it is being actuated.

The present invention also provides a fluid dispenser pump that is simple and inexpensive to manufacture and to assemble.

The present invention thus provides a fluid dispenser pump for associating with a fluid reservoir, said pump comprising a pump body, a pump chamber, and at least a first piston that is slidable in said pump chamber so as to dispense the fluid through a dispenser orifice, said pump including a priming air channel that connects said pump chamber to said reservoir while the pump is being primed.

Advantageously, said pump includes a hollow dip tube that internally defines a fluid channel that connects the pump chamber to the reservoir so as to feed fluid into said pump chamber, said priming air channel being separate from said fluid channel.

Advantageously, said priming air channel is formed outside said dip tube.

Advantageously, said dip tube is inserted into a central channel of said first piston, said priming air channel being formed between said dip tube and said central channel of the first piston.

Advantageously, said central channel of said first piston comprises both a clamping portion in which said dip tube is fitted and a portion of greatest diameter that co-operates with said dip tube to define said priming air channel, at least one through orifice being made through the wall of said central channel of said first piston, in said portion of greatest diameter, so as to connect said priming air channel to said pump chamber during priming.

Advantageously, said pump chamber includes an inlet valve that separates the pump chamber from the dip tube, said inlet valve comprising a valve member and a valve seat that is secured to the first piston.

Advantageously, said first piston slides in leaktight manner in said pump body, said pump body including an opening that co-operates with the first piston during priming, so as to open said priming air channel and enable the air that is contained in the pump chamber before the first actuation to flow through the priming air channel and into the reservoir.

Advantageously, said first piston and said valve seat are made integrally with a fastener element, such as a snap-fastenable, crimpable, or screw-fastenable ring, that is adapted to fasten said pump on the fluid reservoir.

Advantageously, said pump includes a closure member that is movable and/or deformable between a closed position of the dispenser orifice and an open position of the dispenser orifice.

Advantageously, the pump body is made integrally with said closure member.

Advantageously, said closure member is urged resiliently, in particular by a spring, towards its closed position, and is moved and/or deformed towards its open position by the pressure of the fluid that is contained in the pump chamber.

Advantageously, said pump includes a dispenser head that incorporates said dispenser orifice, said closure member including at least one piston that slides, preferably axially, in said head.

Advantageously, a single spring urges said first piston towards its rest position, and said closure member towards its closed position.

Advantageously, said spring is not in contact with the fluid.

The present invention also provides a fluid dispenser device comprising a fluid reservoir and a pump as described above.

Other characteristics and advantages of the present invention appear more clearly from the following detailed description thereof, given by way of non-limiting example, and with reference to the accompanying drawings, and in which.

Figure 1:
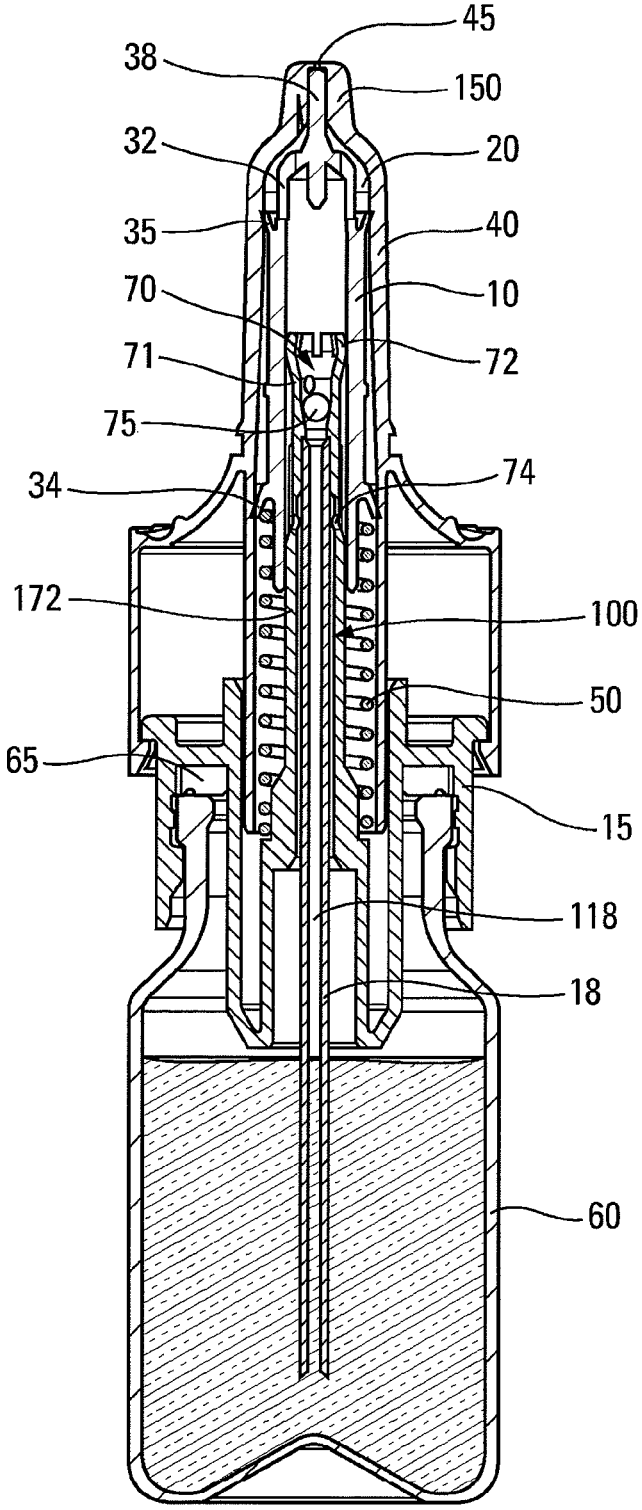
FIG. 1 is a diagrammatic section view of a fluid dispenser device including a pump constituting an advantageous embodiment of the present invention, shown in the rest position.

With reference to the figures, the dispenser pump of the present invention includes a pump body 10 in which at least a first piston 72 slides. The first piston 72 defines, in part, a pump chamber 20, and actuating the pump causes a dose of fluid contained in the pump chamber 20 to be dispensed through a dispenser orifice 45, preferably formed in a dispenser head 40. The pump advantageously includes a closure member 38 that is disposed directly upstream from the dispenser orifice 45, and that co-operates with said dispenser orifice by being movable and/or deformable between a closed position of the dispenser orifice 45 and an open position thereof. The present invention therefore applies, in particular, to PFS devices that are provided with such a closure member. The pump chamber can include an inlet valve 70 that can be made in the form of a bead 75 that forms a valve member and that co-operates with a valve seat 71. The pump body 10 is preferably formed integrally with the closure member 38, on the inside thereof, the first piston 72 sliding inside the pump body 10. The piston 72 and the valve seat 71 are advantageously made as a single part that can also incorporate a fastener ring 15 that is adapted to fasten the pump on a reservoir 60 containing the fluid, with a sealing gasket 65 advantageously being interposed therebetween. A dip tube 18 for extending to the bottom of the reservoir 60 so as to dispense all of the fluid that it contains can also be made integrally with said part that forms a fastener ring 15, a piston 72, and a valve seat 71. The valve member 75 is shown in the form of a bead, but it could be made in some other way.

According to the invention, the pump includes a priming air channel 100 that is adapted to connect the pump chamber 20 to the reservoir, preferably only while the pump is being primed. The channel 100 is preferably separate from the dip tube 18, such that the priming air is no longer expelled to the bottom of the reservoir via the dip tube, thereby avoiding the creation of air bubbles in the fluid that might possibly be sucked back later. Priming is thus improved and doses are more uniform. In addition, when the fluid is relatively viscous, expelling the priming air through the dip tube can turn out to be difficult, or even impossible, the air not having enough energy to reach the mouth of the dip tube at the bottom of the reservoir. By physically separating the paths taken by the priming air and by the fluid, the present invention makes it possible to overcome those drawbacks, in particular in PFS devices. Separating the liquid and air paths also makes it possible to optimize the dimension of the dip tube as a function of the fluid to be used.

The air channel 100 is advantageously formed outside the dip tube 18, in particular around said dip tube. The hollow inside of the dip tube 18 thus forms a fluid channel 118, and the air channel is formed around the fluid channel. In the embodiment in the figures, the dip tube 18 is inserted, in particular force fitted, in a hollow central channel 172 of the first piston 72. The air channel 100 is thus formed between the outside of the dip tube 18 and the inside of the central channel 172. Preferably, said central channel 172 comprises both a clamping portion in which the dip tube 18 is force fitted, e.g. at its top end as shown in the figures, and a portion of greatest diameter that co-operates with said dip tube 18 to define said air channel 100. At least one through orifice 74 is made through the wall of said portion of greatest diameter of the central channel. In the drawings, there are two through orifices, but there can be any number.

Figure 2:
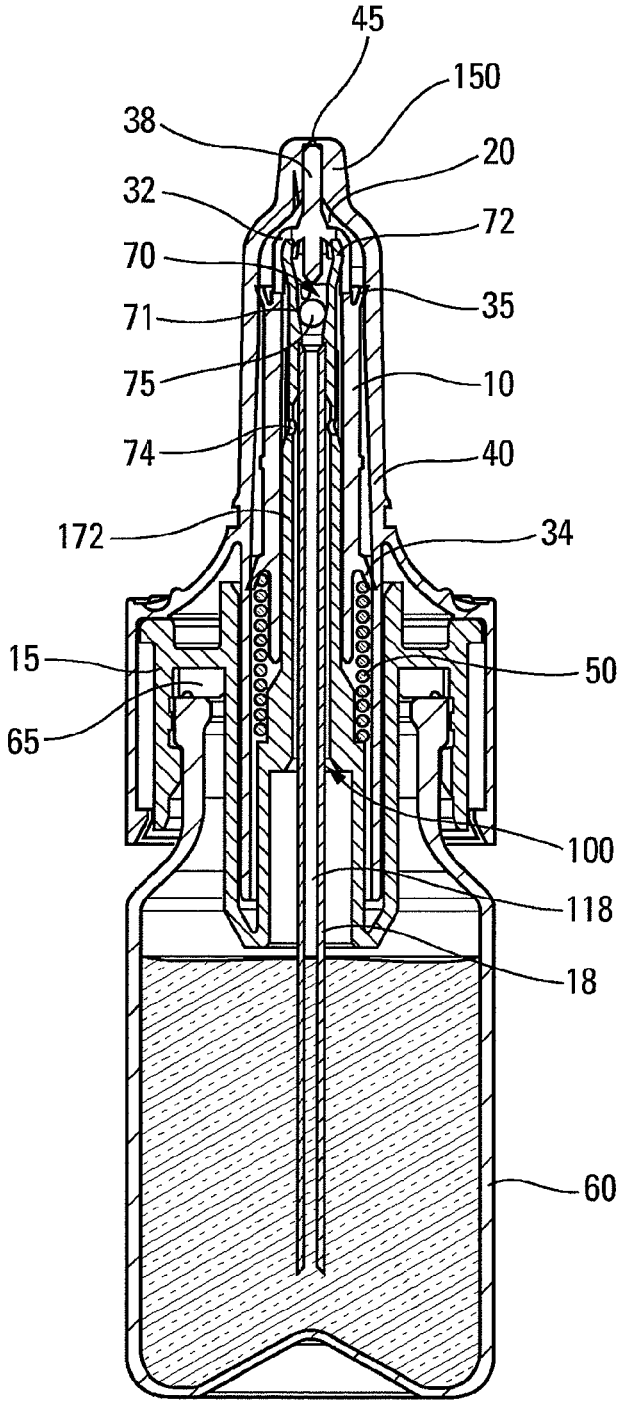
FIG. 2 is a view similar to the view in FIG. 1, shown in the priming position.
Figure 3:
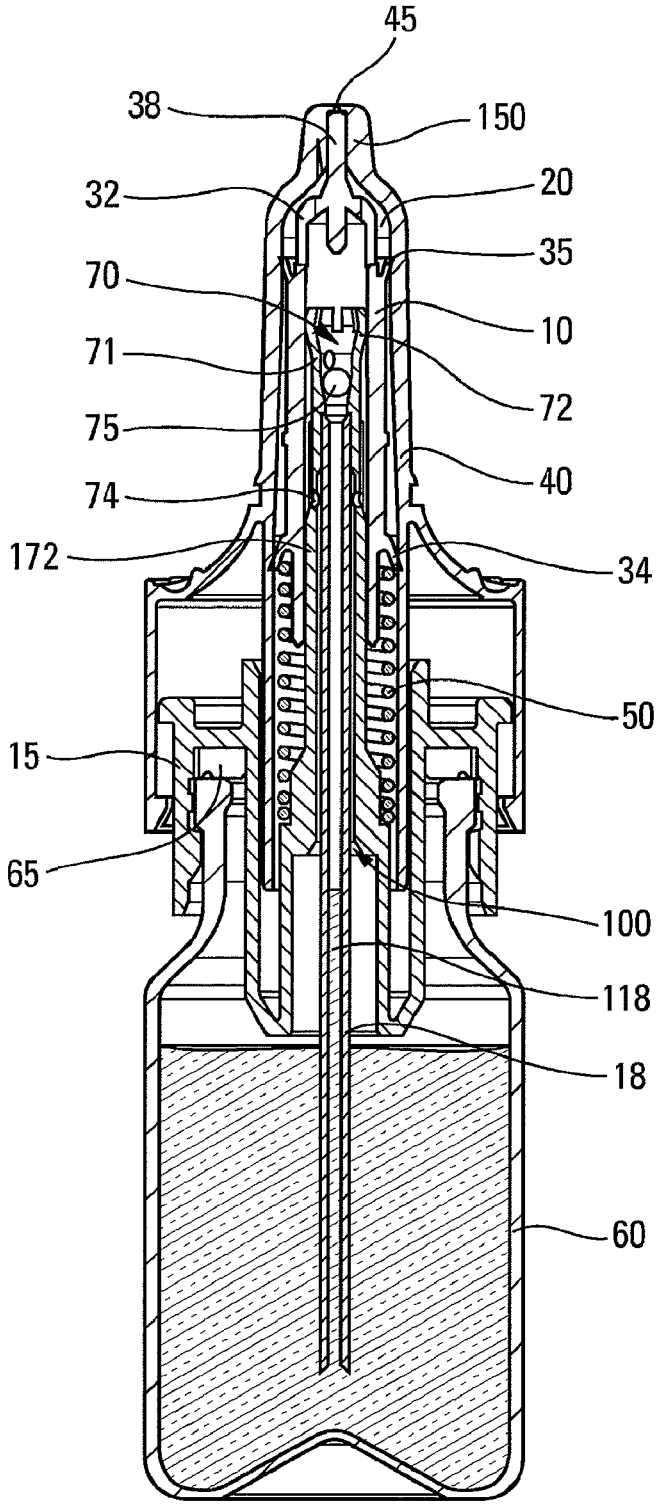
FIG. 3 shows a view similar to the view in FIG. 2, shown in a position during actuation.

In particular, each through orifice 74 can be made in the form of a lateral borehole made in the valve seat 71 upstream from the valve member 75. The valve seat 71 is thus advantageously disposed upstream from the first piston 72 that slides in leaktight manner in said pump body. The pump body preferably includes an opening 32 that is adapted to co-operate with said first piston 72 during priming. The priming position is shown in particular in FIG. 2. It should be observed that when the user actuates the pump for the first time, and when said pump contains air in the pump chamber 20, the air becomes compressed, thereby closing the inlet valve 70 by pressing the bead 75 against the valve seat 71. Since air is compressible, the first piston 72 can slide inside the pump body 10, without the closure member 38 moving relative to the dispenser head 40. When the first piston 72 reaches the opening 32 of the pump body 10, a passage is created between the pump chamber 20 and the priming air channel 10Q, via the outside of the piston 72 and the through orifice 74, thereby making it possible to expel the air that is contained in the pump chamber 20 into the reservoir 60, above the surface of the fluid. After priming, when the pump is returned to its rest position by the return spring 50, fluid is sucked into the pump chamber 20. Thereafter, the first piston 72 can no longer reach said opening 32 in the pump body 30 during normal operation of the pump, i.e. while fluid is being dispensed, but possibly only at the end of actuation, such that there is no risk of fluid being expelled into the air channel 100. Said inlet valve 70 thus functions in conventional manner, closing during actuation, and opening when the pump is returned to its rest position.

The pump advantageously includes only one spring 50 that is adapted to return the first piston 72 to its rest position, and the closure member 38 to its closed position after each actuation. Advantageously, the spring 50 is not in contact with the fluid, thereby eliminating any risk of spoiling the fluid in question. The closure member 38 advantageously slides axially between its open and closed positions in a sleeve 150 that is provided in the bottom of the actuator head 40. A spray profile (not shown) is preferably formed in said sleeve, so as to swirl the fluid so as to form a spray.

The closure member 38 can include second and third pistons 34 and 35 that are preferably made integrally with said closure member 38. Said second and third pistons 34 and 35 can slide in leaktight manner in the head 40, between a sealed closed position and an open position, e.g. in portions of the head 40 that can have different diameters.

The invention is described above with reference to a particular embodiment thereof, but naturally various modifications could be made thereto. In particular, the dip tube 18 is not necessarily secured to, or made integrally with, the fastener element 15 that fastens the pump on the reservoir 60. In addition, the shapes of the closure member 38, the priming air channel 100, the dip tube 18, the pump body 10, the piston 72, the inlet valve 70, the pump chamber 20, and the other elements could be made differently, if necessary. In addition, the way in which the elements co-operate, and, in particular, the way in which they are fastened to one another, could be modified. Other modifications could also be envisaged by the person skilled in the art, without going beyond the ambit of the present invention, as defined by the accompanying claims.

The invention claimed is:

1. A fluid dispenser pump for associating with a fluid reservoir (60), said pump comprising a pump body (10), a pump chamber (20), and at least a first piston (72) that is slidable in said pump chamber (20) so as to dispense the fluid through a dispenser orifice (45), said pump including a fluid channel (118) that connects the pump chamber (20) to the reservoir (60) so as to feed fluid into said pump chamber (20), and a priming air channel (100) that connects said pump chamber (20) to said reservoir (60) while the pump is being primed, and said priming air channel (100) is separate from said fluid channel (118).

2. A pump according to claim 1, in which said pump includes a hollow dip tube (18) that internally defines said fluid channel (118).

3. A pump according to claim 2, in which said priming air channel (100) is formed outside said dip tube (18).

4. A pump according to claim 2, in which said dip tube (18) is inserted into a central channel (172) of said first piston (72), said priming air channel (100) being formed between said dip tube (18) and said central channel (172) of the first piston (72).

5. A pump according to claim 4, in which said central channel (172) of said first piston (72) comprises both a clamping portion in which said dip tube (18) is fitted and a portion of greatest diameter that co-operates with said dip tube (18) to define said priming air channel (100), at least one through orifice (74) being made through the wall of said central channel (172) of said first piston (72), in said portion of greatest diameter, so as to connect said priming air channel (100) to said pump chamber (20) during priming.

6. A pump according to claim 1, in which said pump chamber (20) includes an inlet valve (70) that separates the pump chamber (20) from the dip tube (18), said inlet valve (70) comprising a valve member (75) and a valve seat (71) that is secured to the first piston (72).

7. A pump according to claim 6, in which said first piston (72) and said valve seat (71) are made integrally with a fastener element (15), such as a snap-fastenable, crimpable, or screw-fastenable ring, that is adapted to fasten said pump on the fluid reservoir (60).

8. A pump according to claim 1, in which said first piston (72) slides in leaktight manner in said pump body (10), said pump body (10) including an opening (32) that co-operates with the first piston (72) during priming, so as to open said priming air channel (100) and enable the air that is contained in the pump chamber (20) before the first actuation to flow through the priming air channel (100) and into the reservoir (60).

9. A pump according to claim 1, in which said pump includes a closure member (38) that is movable and/or deformable between a closed position of the dispenser orifice (45) and an open position of the dispenser orifice (45).

10. A pump according to claim 9, in which the pump body (10) is made integrally with said closure member (38).

11. A pump according to claim 9, in which said closure member (38) is urged resiliently, in particular by a spring (50), towards its closed position, and is moved and/or deformed towards its open position by the pressure of the fluid that is contained in the pump chamber (20).

12. A pump according to claim 9, in which said pump includes a dispenser head (40) that incorporates said dispenser orifice (45), said closure member (38) including at least one piston (34, 35) that slides, preferably axially, in said head (40).

13. A pump according to claim 9, in which a single spring (50) urges said first piston (72) towards its rest position, and said closure member (38) towards its closed position.

14. A pump according to claim 13, in which said spring (50) is not in contact with the fluid.

15. A fluid dispenser device including a fluid reservoir (60), said device being characterized in that it further includes a pump according to claim 1.

16. A fluid dispenser pump for associating with a fluid reservoir, comprising:

a pump body;

a pump chamber a first piston slidable in the pump chamber configured to dispense fluid from the fluid reservoir through a dispenser orifice when the dispenser is associated with the fluid reservoir;

a fluid channel configured to connect the pump chamber to the reservoir so as to feed the fluid into the pump chamber;

a priming air channel that connects the pump chamber to the reservoir while the pump is being primed, the priming air channel is separate from the fluid channel so that during priming air contained in the pump is first introduced into the reservoir above the surface of the fluid.

17. A fluid dispenser pump for associating with a fluid reservoir, comprising:

a pump body;

a pump chamber a first piston slidable in the pump chamber configured to dispense fluid from the fluid reservoir through a dispenser orifice when the dispenser is associated with the fluid reservoir;

a fluid channel configured to connect the pump chamber to the reservoir so as to feed the fluid into the pump chamber; and means for priming the pump so that during priming air contained in the pump is introduced into the reservoir.

* * * * *